US009116508B2

(12) United States Patent
Kyou

(10) Patent No.: US 9,116,508 B2
(45) Date of Patent: Aug. 25, 2015

(54) ANALOG ELECTRONIC TIMEPIECE WHICH CONTROLS HAND MOVEMENT BASED ON MEASUREMENT OF AN EXTERNAL MAGNETIC FIELD

(71) Applicant: CASIO COMPUTER CO., LTD., Shibuya-ku, Tokyo (JP)

(72) Inventor: Kazuho Kyou, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/171,711

(22) Filed: Feb. 3, 2014

(65) Prior Publication Data

US 2014/0219068 A1 Aug. 7, 2014

(30) Foreign Application Priority Data

Feb. 5, 2013 (JP) ..... 2013-019997

(51) Int. Cl.

| | |
|---|---|
| ***G04G 5/04*** | (2006.01) |
| ***G04C 3/14*** | (2006.01) |
| ***G04B 47/06*** | (2006.01) |
| *G04G 21/02* | (2010.01) |

(52) U.S. Cl.

CPC ..... *G04C 3/143* (2013.01); *G04B 47/065* (2013.01); *G04C 3/146* (2013.01); *G04G 21/02* (2013.01)

(58) Field of Classification Search

CPC ..... G04C 3/14; G04C 3/143; G04C 3/146; G04B 47/06; G04B 47/065; G04G 21/02; G01C 17/30

USPC ..... 368/11, 80

See application file for complete search history.

(56) References Cited

U.S. PATENT DOCUMENTS

| | | | | |
|---|---|---|---|---|
| 6,038,523 | A * | 3/2000 | Akahane et al. | 702/150 |
| 6,194,862 | B1 * | 2/2001 | Hara | 318/696 |
| 2003/0174584 | A1 * | 9/2003 | Fujisawa et al. | 368/47 |
| 2009/0016172 | A1 * | 1/2009 | Fujii et al. | 368/80 |
| 2010/0142331 | A1 * | 6/2010 | Kimura et al. | 368/187 |
| 2010/0309756 | A1 * | 12/2010 | Kimura et al. | 368/293 |
| 2011/0013494 | A1 * | 1/2011 | Sato et al. | 368/200 |
| 2011/0249538 | A1 * | 10/2011 | Aoki | 368/187 |

FOREIGN PATENT DOCUMENTS

| | | | |
|---|---|---|---|
| JP | 05-312573 | A | 11/1993 |
| JP | 3596201 | B2 | 12/2004 |

* cited by examiner

*Primary Examiner* — Amy Cohen Johnson
*Assistant Examiner* — Matthew Powell
(74) *Attorney, Agent, or Firm* — Holtz, Holtz, Goodman & Chick PC

(57) ABSTRACT

An analog electronic timepiece includes a magnetic field measurement unit; a time counting unit; a plurality of hands which are arranged so as to be rotatable; a hand control unit which controls rotation of the plurality of hands; and a timing control unit which controls such that a period of time for executing the rotation of the hands by the hand control unit does not overlap with a period of time for measuring an external magnetic field by the magnetic field measurement unit.

18 Claims, 9 Drawing Sheets

ANALOG ELECTRONIC TIMEPIECE WHICH CONTROLS HAND MOVEMENT BASED ON MEASUREMENT OF AN EXTERNAL MAGNETIC FIELD

BACKGROUND OF THE INVENTION

1. Field of the Invention

The present invention relates to an analog electronic timepiece which includes a measuring function of geomagnetic field.

2. Description of Related Art

Conventionally, there have been analog electronic timepieces which individually drive a plurality of stepping motors and can independently move their corresponding hands. Such analog electronic timepieces can rapidly move the hands in a case where a plurality of hands are used for a purpose other than time display and in a case where positions of hands according to time display are largely moved.

Such analog electronic timepieces include multifunctional electronic timepieces which have a function of measuring various physical quantities such as the acceleration, magnetic field (geomagnetic field), atmosphere and temperature and displaying information according to the physical quantities. Some of the multifunctional electronic timepieces are provided with one or a plurality of functional hand(s) for displaying the information in addition to an hour hand, a minute hand and a secondhand for the time display. Also, even in a case where the functional hand is not provided, the display according to the function may be performed by operating only one or two hand(s) as in a case where compass display or direction display is performed on the basis of measurement of geomagnetic field. In these cases, the time display can be simultaneously performed in parallel by a hand other than the functional hand or a hand which is not used for functional display.

However, in analog electronic timepieces, a magnetic field is generated according to rotation of a rotor when a stepping motor is driven. In addition, the stepping motor is easily magnetized to produce an offset magnetic field, and thus the offset magnetic field changes during the rotation of the rotor. Especially, the magnetic field measured at a compact wristwatch is easily influenced by the offset magnetic field. Thus, conventionally, there has been known an electronic analog timepiece which detects an operation state of a stepping motor and detects a direction only in a state where the stepping motor is stopped, and such electronic analog timepiece is described in Japanese Patent Laid-Open Publication No. H5-312573, for example. Also, Japanese Patent No. 3596201 describes a technique in which the direction is detected with the same period as the period of hand operation according to the time display and at a phase different from the hand operation.

However, in a case where magnetic field measurement and display of the magnetic field and direction are performed along with time display by using hands of the analog electronic timepiece, the rotation angle of hand per rotation changes according to the amount of change in the measured magnetic field. Since the rotation frequency (rotation speed) of hand is determined according to conditions such as performance of stepping motor and gear, time required for moving hands also changes according to the rotation angle per rotation. Accordingly, in a case where a desired time resolution of magnetic field measurement is high compared to the rotation speed of hand, there is a possibility that the hand operation for displaying magnetic field and direction and the magnetic field measurement thereafter are performed at a timing which overlaps an operation timing of the hands according to time display. That is, by the time which is required for the magnetic field measurement and the hand operation according to the magnetic field display changing irregularly, the hands used for the time display cannot be operated at the accurate timing and, and the time interval of magnetic field measurement becomes inappropriately large, which disturbs comfortable use of a user.

The present invention relates to an analog electronic timepiece which can perform, in parallel, information display according to time counting operation and information display according to magnetic field measurement which a user can comfortably obtain.

SUMMARY OF THE INVENTION

According to one aspect of the present invention, there is provided an analog electronic timepiece, including: a magnetic field measurement unit; a time counting unit; a plurality of hands which are arranged so as to rotate freely; a hand control unit which controls rotation of the plurality of hands; and a timing control unit which executes the rotation of the hands by the hand control unit and measurement of a magnetic field by the magnetic field measurement unit so that periods of time do not overlap each other, wherein at least one hand of the plurality of hands is independent drive hand(s) which is rotatable independently from other hand(s) by the hand control unit, the hand control unit makes a part or all of the independent drive hand(s) indicate a predetermined direction based on measurement data by the magnetic field measurement unit and makes other hand(s) among the plurality of hands as time hand(s) indicate a current time at a predetermined time interval, the current time being counted by the time counting unit, when the current time becomes a timing of a movement operation of the time hand(s) during the measurement of the magnetic field, in a case where the time hand(s) includes a hand for which the predetermined time interval is less than a predetermined setting time, the timing control unit interrupts the measurement of the magnetic field and performs the movement operation of the time hand(s), and in a case where the time hand(s) does not include the hand for which the predetermined time interval is less than the predetermined setting time, the movement operation of the time hand(s) is postponed until the measurement of the magnetic field is finished.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Hereinafter, embodiments of the present invention will be described on the basis of the drawings.

First Embodiment

Figure 1:
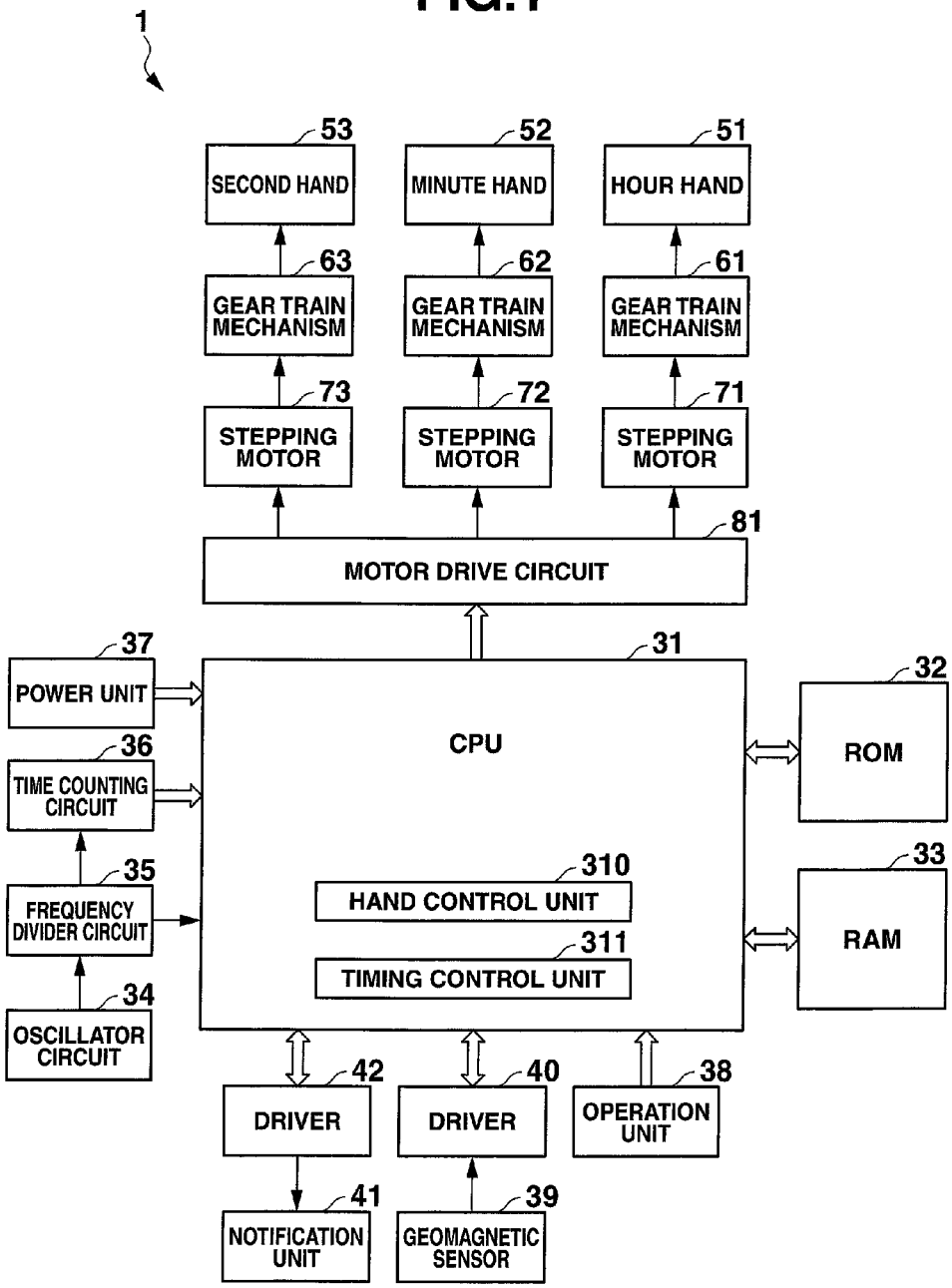
FIG. 1 is a block diagram showing an internal configuration of an analog electronic timepiece of a first embodiment of the present invention.

FIG. 1 is a block diagram showing an internal configuration of an analog electronic timepiece 1 of the first embodiment of the present invention.

The analog electronic timepiece 1 of this embodiment is a portable type which can move three hands independently from each other, and, though not especially limited, the analog electronic timepiece 1 is an electronic wristwatch which includes a band to be worn around an arm, for example. The analog electronic timepiece 1 includes an hour hand 51, a stepping motor 71 which drives the hour hand 51 via a gear train mechanism 61, a minute hand 52, a stepping motor 72 which drives the minute hand 52 via a gear train mechanism 62, a second hand 53, a stepping motor 73 which drives the second hand 53 via a gear train mechanism 63, a motor drive circuit 81, a CPU (Central Processing Unit) 31 (hand control unit 310 and timing control unit 311), a ROM (Read Only Memory) 32, a RAM (Random Access Memory) 33, an oscillator circuit 34, a frequency divider circuit 35, a time counting circuit 36 as a time counting unit, a power unit 37, an operation unit 38, a geomagnetic field sensor 39 as a magnetic field measurement unit, a driver 40 thereof, a notification unit 41, a driver 42 thereof and such like.

The hour hand 51, the minute hand 52 and the second hand 53 (hereinafter, also collectively called hands 51 to 53 for the analog electronic timepiece 1 of the first embodiment) are hands (independent drive hands) which are rotated freely and independently from each other around rotation shafts provided at a same position which is nearly central on a dial plate provided with scale marks for time display and marks for direction display. Though not especially limited, the hour hand 51 and the minute hand 52 can rotationally move by one degree for each step drive of the stepping motors 71 and 72, respectively, and make one rotation on the dial plate by movement of 360 steps. The second hand 53 can rotationally move by six degrees for a step drive of the stepping motor 73, and makes one rotation on the dial plate by movement of 60 steps. That is, when displaying time, the second hand 53 moves one step per second, the minute hand 52 moves one step for every ten seconds and the hour hand 51 moves one step for every two minutes.

The motor drive circuit 81 outputs, at an appropriate timing, a drive voltage pulse for driving the stepping motors 71 to 73 on the basis of a control signal input from the CPU 31. The motor drive circuit 81 can output the drive voltage pulse by adjusting the drive voltage value and pulse width of the stepping motors 71 to 73 on the basis of a set operation by the CPU 31. The motor drive circuit 81 of the embodiment is set so as to be able to output, to each of the stepping motors 71 to 73, the drive voltage pulse to rotate the rotor at 64 pps (Pulse per second) in the forward direction and at 32 pps in the backward direction at the fastest speed, for example.

The CPU 31 performs a variety of arithmetic processing and integrated control for the entire operation of the analog electronic timepiece 1.

The CPU 31 reads out and executes control programs stored in the ROM 32 and continuously makes the units perform operations according to the time display. The CPU 31 also makes the units perform direction display on the basis of the operation control program according to the magnetic field measurement and display thereof.

In the analog electronic timepiece 1, the CPU 31 constantly performs detection processing according to the hand movement operation, and compares the current hand position data stored in the RAM 33 with a set hand position data (destination setting data) to perform processing of moving the hand to a position indicated by the destination setting data if there is a gap between the data. Also, when a fast forward flag of the hands 51 to 53 is set, the CPU 31 detects the fast forward flag, invokes and executes interrupt processing for fast forwarding the hands 51 to 53 according to a fast forward speed, a fast forward direction and a fast forward destination position which are set together with the fast forward flag.

Various control programs and initial setting data are stored in the ROM 32. When the analog electronic timepiece 1 is activated, the control programs are read out and continuously executed by the CPU 31. Magnetic field measurement programs are also stored in the ROM 32 and invoked on the basis of the input operation of the operation unit 38 to continuously perform processing according to the magnetic field measurement and the display operation based on the magnetic field measurement for a predetermined period of time.

The RAM 33 is a volatile memory such as a SRAM and a DRAM, and provides the CPU 31 with a working memory. User setting data which is set on the basis of the input operation of the operation unit 38 can be temporarily stored in the RAM 33. A part of the RAM 33 may be replaced with a non-volatile memory such as a flash memory and an EEPROM (Electrically erasable and programmable read only memory).

The oscillator circuit 34 generates a predetermined frequency signal and outputs the signal to the frequency divider circuit 35. As the oscillator circuit 34, a crystal oscillator is used, for example.

The frequency divider circuit 35 divides the signal input from the oscillator circuit 34 into signals of various frequencies to be used by the CPU 31 and the time counting circuit 36, and outputs the divided signals.

The time counting circuit 36 is a counter circuit which counts the number of times of a predetermined frequency signal (for example, 16 Hz) which is input from the frequency divider circuit 35 and adds the number to the initial time to count a current time. The current time counted by the time counting circuit 36 is read out by the CPU 31 and used for time display. Alternatively, the time counting may be controlled in software by the CPU 31 by using the RAM.

The power unit 37 supplies electric power by a predetermined voltage to operate the units of the analog electronic timepiece 1. The power unit 37 is configured so as to be able to operate the analog electronic timepiece 1 continuously and stably for a long period, and formed by combining a solar cell with a secondary cell, for example.

The operation unit 38 receives input operation by a user to convert the input into an electric signal, and outputs the electric signal to the CPU 31. In the analog electronic timepiece 1 of the embodiment, the operation unit 38 is provided with one or a plurality of push button switch(es). Alternatively, the operation unit 38 may be provided with a winding crown in addition to or instead of the push button switch (es).

The geomagnetic field sensor 39 measures geomagnetic field in three axis directions which are orthogonal to each other or in two axis directions which are parallel to the dial plate. The electric signal corresponding to the geomagnetic field measured by the geomagnetic field sensor 39 is input in a predetermined format to the CPU 31 via the driver 40, and digitally converted at a predetermined sampling rate. The CPU 31 performs predetermined processing such as coordinate conversion to the digital value of geomagnetic field which is obtained over a predetermined period of time (for example, 200 ms), and identifies the direction of magnetic north. The CPU 31 displays the identified direction of magnetic north by moving one or a plurality of hands among the hands 51 to 53, here, the second hand 53, when the analog electronic timepiece 1 performs display according to the compass function, for example.

The notification unit 41 includes an audio output element for generating beep sound, for example. As the audio output element, a piezoelectric element is used, for example. The driver 42 outputs a drive voltage signal for generating the beep sound from the notification unit 41 to the notification unit 41 on the basis of the control signal input from the CPU 31. In a case where an alarm function is effective, for example, the CPU 31 outputs the control signal to the driver 42 at an alarm setting time to make the notification unit 41 generate the beep sound. The notification unit 41 may include a light emitting element such as an LED (Light emitting diode) and a vibration motor.

Next, operations according to direction display in the analog electronic timepiece 1 of the embodiment will be described.

In the analog electronic timepiece 1 of the embodiment, in a case where direction display is to be performed, the direction of magnetic north which is measured every second is continuously indicated by the second hand 53 over a preset period of time, 20 seconds, for example, while time display by the hour hand 51 and the minute hand 52 (hereinafter, called time hands 51 and 52 in the first embodiment) is continued.

Figure 2A:
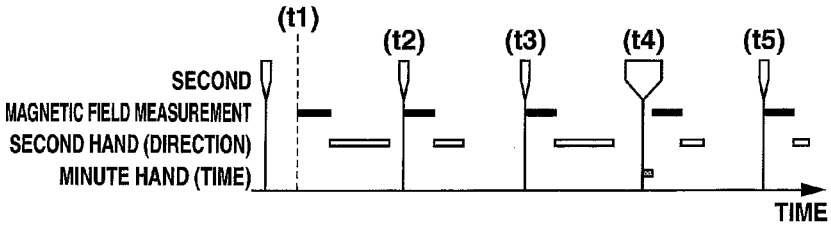
FIGS. 2A to 2C are time charts which explain timings of magnetic field measurement and hand operation in the analog electronic timepiece of the first embodiment.
Figure 2B:
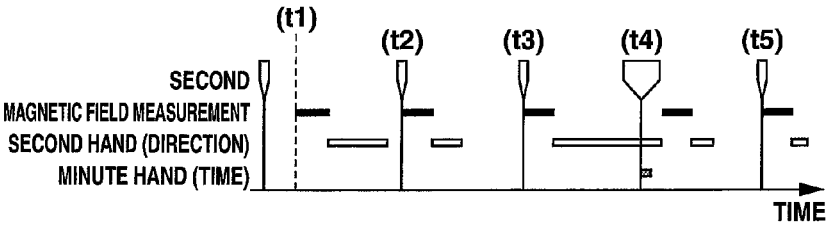
Figure 2C:
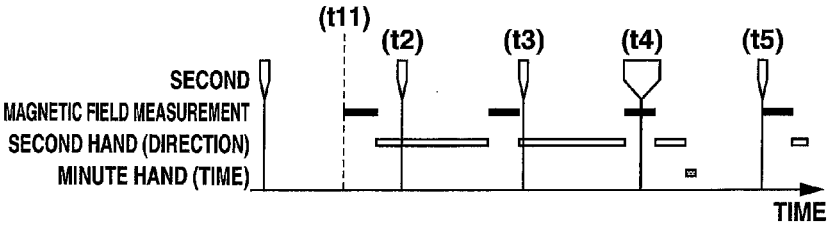

FIGS. 2A to 2C are time charts showing timings of magnetic field measurement and hand operation in a case where direction display is performed in the analog electronic timepiece 1 of the embodiment.

In the analog electronic timepiece 1 of the embodiment, when each of the hands 51 to 53 moves one step, a drive voltage pulse with a pulse width (duration time) which is approximately several milliseconds is output to the stepping motors 71 to 73 from the motor drive circuit 81. The drive voltage pulse is not simultaneously output to two or more of the stepping motors 71 to 73. When a drive control signal indicating simultaneous drive of a plurality of motors among the stepping motors 71 to 73 is input from the CPU 31 to the motor drive circuit 81, the drive voltage pulse is output to the stepping motors 71 to 73 in turns. As described above, the upper limit of continuous operation speed of the hands 51 to 53 is 32 pps (once per 31.25 ms) or 64 pps (once per 15.625 ms). Accordingly, for example, the motor drive circuit 81 can fast forward the hands 51 to 53 in parallel at 64 pps by outputting, at a pulse width of 5 ms, the drive voltage pulse to operate each of the hands 51 to 53 by shifting the timing by 5 ms from each other.

On the other hand, the magnetic field measurement is essentially started once per second at a timing (called a second synchronization point) of the head of each second, and each of the measurement is performed over a predetermined period of time, for example, 200 ms. However, since the rotors of the stepping motors 71 to 73 generate change in offset magnetic field during the rotation operation and for a while after the rotation, the magnetic field measurement needs to be set at a period of time which does not overlap the above period of time. When the magnetic field measurement is finished and the position to be indicated by the second hand 53 is calculated on the basis of the measured value, fast forward operation to fast forward the second hand 53 to the calculated position is performed.

Accordingly, as shown in FIG. 2A, the magnetic field measurement is performed over a predetermined period of time at the starting point (t1) of magnetic field measurement and second synchronization points (t2, t3 and t5) of each second after the starting point, then, fast forward operation of the second hand 53 is performed on the basis of the measurement result. However, at the second synchronization point (t4) (hereinafter, called a timing of ten seconds carry) when the minute hand 52 moves once per ten seconds, the magnetic field measurement is performed after the drive of the stepping motor 72 moving the minute hand 52 is finished. Then, the fast forward operation of the second hand 53 is performed after the magnetic field measurement.

At direction display, the hand according to the direction display, here, the second hand 53 is fast forwarded at 32 pps in either case of movement in forward direction and backward direction so that the movement is performed evenly. Accordingly, when the hand is rotated backward by 180 degrees due to the rapid change in the direction of magnetic field, the hand operation of 30 steps of the second hand 53 requires approximately one second (30/32 second).

As shown in FIG. 2B, there is a possibility that the fast forward operation of the second hand 53 requires long time and the fast forward operation is not finished at the timing of ten seconds carry. In such case, the minute hand 52 and the hour hand 51 if needed are moved while fast forwarding the second hand 53 at the timing (t4) of ten seconds carry. Accordingly, the fast forward rotation of the second hand 53 is not disturbed. In addition, the next magnetic field measurement is started after the movement of the second hand 53 is finished. Accordingly, even in a case where the magnetic field measurement cannot be started at the second synchronization point, the magnetic field measurement is not omitted, but performed.

On the other hand, as shown in FIG. 2C, there is a possibility that the magnetic field measurement overlaps the timing of ten seconds carry as a result of taking a long time for the fast forward operation of the second hand 53 after the start (t11) of the magnetic field measurement. In such case, after the magnetic field measurement is finished, the movement operation of the time hands 51 and 52 is performed. In the embodiment, the movement of the minute hand 52 is performed after the magnetic field measurement is finished and further the movement of the second hand 53 based on the measurement result is finished. In such way, even when the operation timings of the time hands 51 and 52 are slightly shifted from the timing of the ten seconds carry, visual unnaturalness and practical issue rarely occurs.

Also in such case, similarly to the timing (t4) in FIG. 2B, operation of the time hands 51 and 52 and operation of the second hand 53 may be performed in parallel after the magnetic field measurement is finished.

Figure 3:
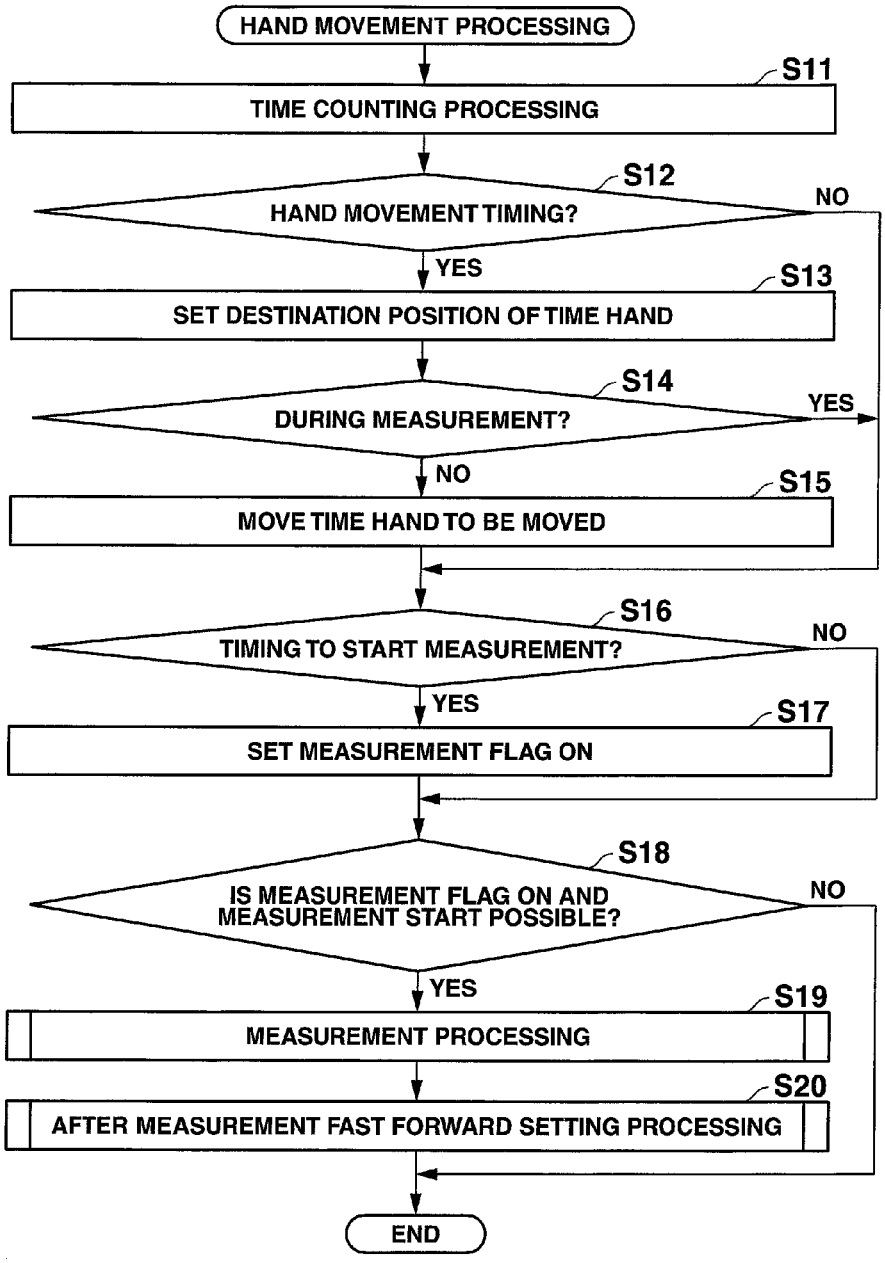
FIG. 3 is a flow chart showing a control procedure of hand movement processing.
Figure 4A:
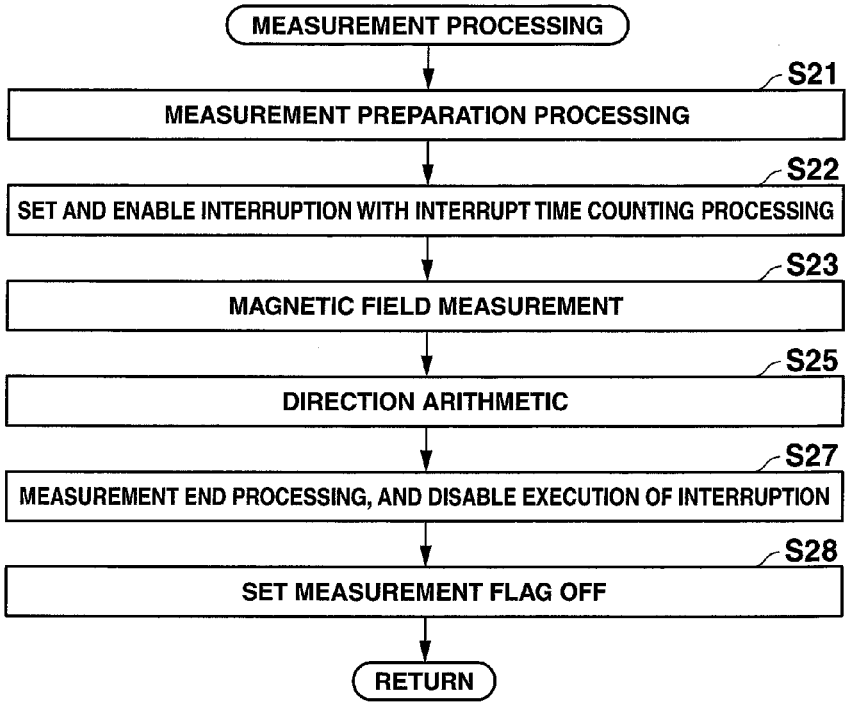
FIGS. 4A and 4B are flowcharts showing control procedures of measurement processing and interrupt time counting processing of the first embodiment.
Figure 4B:
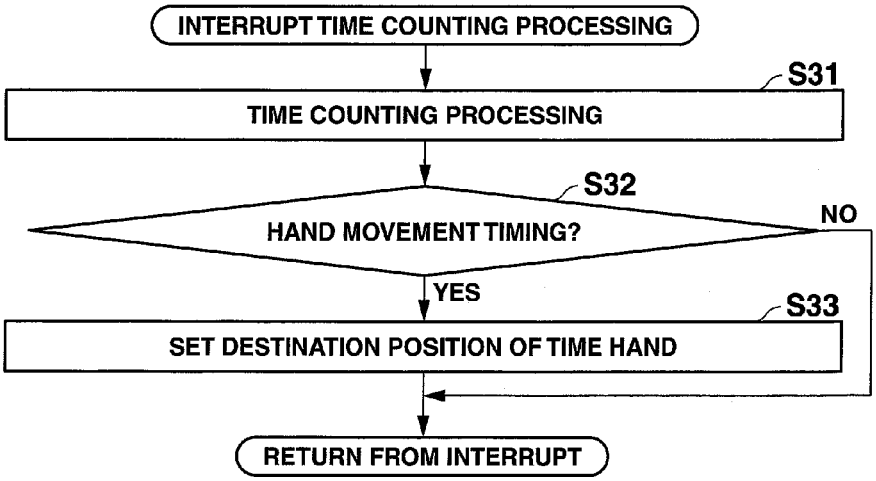
Figure 5:
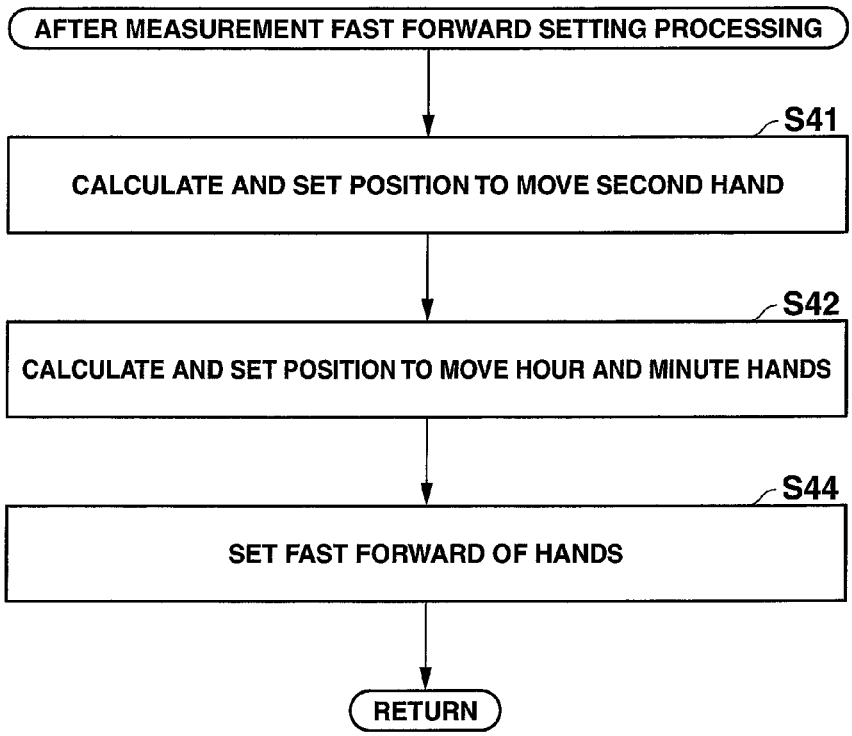
FIG. 5 is a flowchart showing a control procedure of "after measurement fast forward setting processing" of the first embodiment.

FIG. 3 is a flowchart showing a control procedure by the CPU 31 of the hand movement processing which is executed in the analog electronic timepiece 1 of the embodiment. FIGS. 4A and 4B are flowcharts showing control procedures by the CPU 31 of the measurement processing invoked at the hand movement processing and the interrupt time counting processing executed as interrupt into the measurement processing. FIG. 5 is a flowchart showing a control procedure by the CPU 31 of the "after measurement fast forward setting processing" which is invoked at the hand movement processing.

The hand movement processing is repeatedly invoked and executed at the timing of the input of the frequency signal (here, 16 Hz signal) corresponding to the execution timing of the time counting operation when the operation according to the compass function is started and while the operation according to the compass function is being performed.

As shown in FIG. 3, when the hand movement processing is started, the CPU 31 performs time counting processing (step S11). The CPU 31 obtains the current time from the time counting circuit 36.

Then, the CPU 31 determines whether the current time is a hand moving timing, here the timing of ten seconds carry (step S12). If the CPU 31 determines that the current time is not the hand moving timing (NO in step S12), the processing of the CPU 31 shifts to step S16.

On the other hand, if it is determined that the current time is the hand moving timing (YES in step S12), the CPU 31 sets the position data of the time hands 51 and 52 after hand movement as destination setting data (step S13). Then, the CPU 31 determines whether the magnetic field is being measured (step S14). That is, the CPU 31 determines whether after-mentioned measurement processing is being executed. If it is determined that the magnetic field is being measured (YES in step S14), the processing of the CPU 31 shifts to step S16. If it is determined that the magnetic field is not being measured (NO in step S14), the CPU 31 outputs the control signal to the motor drive circuit 81 and moves the time hands to be moved to the positions which are set at the processing of step S13 (step S15). Then, the processing of the CPU 31 shifts to step S16.

After shifting to the processing of step S16, the CPU 31 determines whether the current time is a start timing of magnetic field measurement (step S16). That is, the CPU 31 determines whether the current time is the timing of second synchronization point. If the CPU 31 determines that the current time is the start timing of magnetic field measurement (YES in step S16), the CPU 31 sets the measurement flag on, the measurement flag indicating the setting of a measurement command (step S17), and shifts the processing to step S18. If the CPU 31 determines that the current time is not the timing of magnetic field measurement (NO in step S16), the processing of the CPU 31 shifts to step S18.

When shifting to the processing of step S18, the CPU 31 determines whether the magnetic field measurement may be started (step S18). That is, the CPU 31 determines whether the measurement flag is set on and the movement operation of the hands 51 to 53 is not being performed. If it is determined that the current time is not the timing to start the magnetic field measurement (NO in step S18), the CPU 31 ends the hand movement processing.

If it is determined that the magnetic field measurement may be started (YES in step S18), the CPU 31 invokes and executes after-mentioned measurement processing in accordance with the measurement command according to the measurement flag (step S19). The CPU 31 invokes and executes after-mentioned after measurement fast forward setting processing (step S20). Then, the CPU 31 ends the hand movement processing.

Next, the measurement processing which is invoked at the processing of step S19 will be described.

When the measurement processing is invoked, as shown in FIG. 4A, the CPU 31 performs measurement preparation processing (step S21). The CPU 31 performs operation preparation of the geomagnetic sensor 39 and preparation operations according to initial setting such as reservation of a storage area of measurement data obtained from the geomagnetic sensor 39. Then, the CPU 31 sets and enables an interrupt operation (step S22). That is, the CPU 31 performs setting for receiving after-mentioned interrupt time counting processing and executing the interrupt operation at predetermined time intervals while the magnetic field measurement is being performed.

The CPU 31 performs the magnetic field measurement (step S23). The CPU 31 obtains output data of the geomagnetic sensor 39 in a predetermined format via the driver 40 for a predetermined period of time (for example, 200 ms). The predetermined period of time may be changeable according to the conditions such as stability of the measurement value. The CPU 31 performs direction arithmetic on the basis of the obtained magnetic field data (step S25). That is, the CPU 31 calculates the direction of magnetic north in the analog electronic timepiece 1.

The CPU 31 performs measurement end processing, and performs setting of disabling interrupt execution of the enabled interrupt time counting processing (step S27). Finally, the CPU 31 changes the measurement flag to off (step S28), and thereafter ends the measurement processing to return the processing to the hand movement processing.

In the measurement processing, from when the execution of the interrupt processing is enabled in the processing of step S22 until the execution of the interrupt processing is disabled in the processing of step S27, the interrupt time counting processing is activated as the interrupt operation at the input timing of the 16 Hz signal to perform time counting processing.

As shown in FIG. 4B, in the interrupt time counting processing, the CPU 31 executes the time counting processing (step S31). The CPU 31 determines whether the current time is the hand moving timing, that is, the timing of ten seconds carry (step S32). If the CPU 31 determines that the current time is not the hand moving timing (NO in step S32), the CPU 31 ends the interrupt time counting processing and returns the processing to the initial processing position in the measurement processing.

If it is determined that the current time is the hand moving timing (YES in step S32), the CPU 31 sets the position data of the destinations of the time hands 51 and 52 by hand movement as destination setting data (step S33). Then, the CPU 31 ends the interrupt time counting processing and returns to the initial processing position in the measurement processing.

On the other hand, when the after measurement fast forward setting processing is started, as shown in FIG. 5, the CPU 31 calculates the destination position to move the second hand 53 and the direction to rotationally move the second hand 53 according to the direction of magnetic north and posture of the analog electronic timepiece 1 and sets the destination position and the direction along with the fast forward speed (step S41). Then, the CPU 31 sets movement positions of the time hands 51 and 52 based on the time change during the measurement processing (step S42). The CPU 31 sets a fast forward flag for invoking the processing of fast forward to the destination position which was set (step S44). Then, the CPU 31 ends the after measurement fast forward setting processing and returns the processing to the hand movement processing.

Accordingly, actual fast forward operations of the hands 51 to 53 are separately executed by the above interrupt processing after ending the hand movement processing including the after measurement fast forward setting processing. In the determination processing of step S18 in the hand movement processing which is executed thereafter, the measurement start is determined to be impossible and the processing follows the "NO" arrow until the fast forward operations are finished.

As described above, the analog electronic timepiece 1 of the first embodiment includes the geomagnetic sensor 39, and can simultaneously and continuously perform, for a predetermined period of time, the display of time by the hour hand 51 and the minute hand 52 and the direction display by the second hand 53 which is independently driven by the stepping motor 73. By the measurement of magnetic field being executed for a period of time which does not overlap the operation timing of the stepping motors 71 to 73, the influence of magnetic noise according to the operations of the stepping motors 71 to 73 is prevented from mixing in the magnetic field to be measured. Furthermore, in a case where the current time is the operation timing of stepping motors 71 and 72, that is, the hand moving timing of the hour hand 51 and the minute hand 52 during the measurement of magnetic field in the analog electronic timepiece 1, since the stepping motors 71 and 72 are operated after continuing the magnetic field measurement in priority, continuous measurement and display of magnetic field can be performed in parallel with the time display without lowering the frequency of magnetic field measurement and data quality. Accordingly, the user can prevent delay of display and such like which is not expected and can comfortably obtain time information and information according to the direction display.

Especially, by applying the present invention to a case where a longer time is required for moving the second hand 53 to the display position compared to the interval of the magnetic field measurement, it is possible to perform the direction display in high accuracy and high time resolution in parallel with the time display in the analog electronic timepiece 1.

Also, by giving priority to the magnetic field measurement over the movement operation of hands such as the minute hand 52 and the hour hand 51 in which the small gap in hand moving timing is not perceived as unnatural by the user, it is possible to repeatedly perform the measurement and display of the magnetic field in a desired accuracy and time resolution without generating problems in accuracy of time display.

In a case where the hand operation continuously requires a longer time compared to the interval of magnetic field measurement and the next magnetic field measurement timing comes before the previous magnetic field measurement is finished, since the previous magnetic field measurement is used also as the next magnetic field measurement in this configuration, it is possible to avoid such situation that the measurement command more than necessary is temporarily accumulated and data measurement is needlessly performed while maintaining sufficient measurement frequency in a range which can be set compared to the time of hand operation.

In a case where a command according to the magnetic field measurement is previously set according to a predetermined magnetic field measurement interval and the hand operation is performed at this timing, since the command which is set immediately after the operation ends is executed in this configuration, it is possible to start necessary magnetic field measurement at the executable timing without delay and without lowering the quality of measured magnetic field.

Even in a case where the highest speed at which the second hand 53 can be fast forwarded in the forward direction is different from the highest speed at which the second hand 53 can be forwarded in the backward direction in the direction display using the second hand 53, by setting the second hand 53 to be fast forwarded at the same speed in the both directions, it is possible to perform the direction display by an even and smooth display without providing a feeling of strangeness to the user.

Second Embodiment

Next, an analog electronic timepiece 1*a* of the second embodiment will be described.

Figure 6:
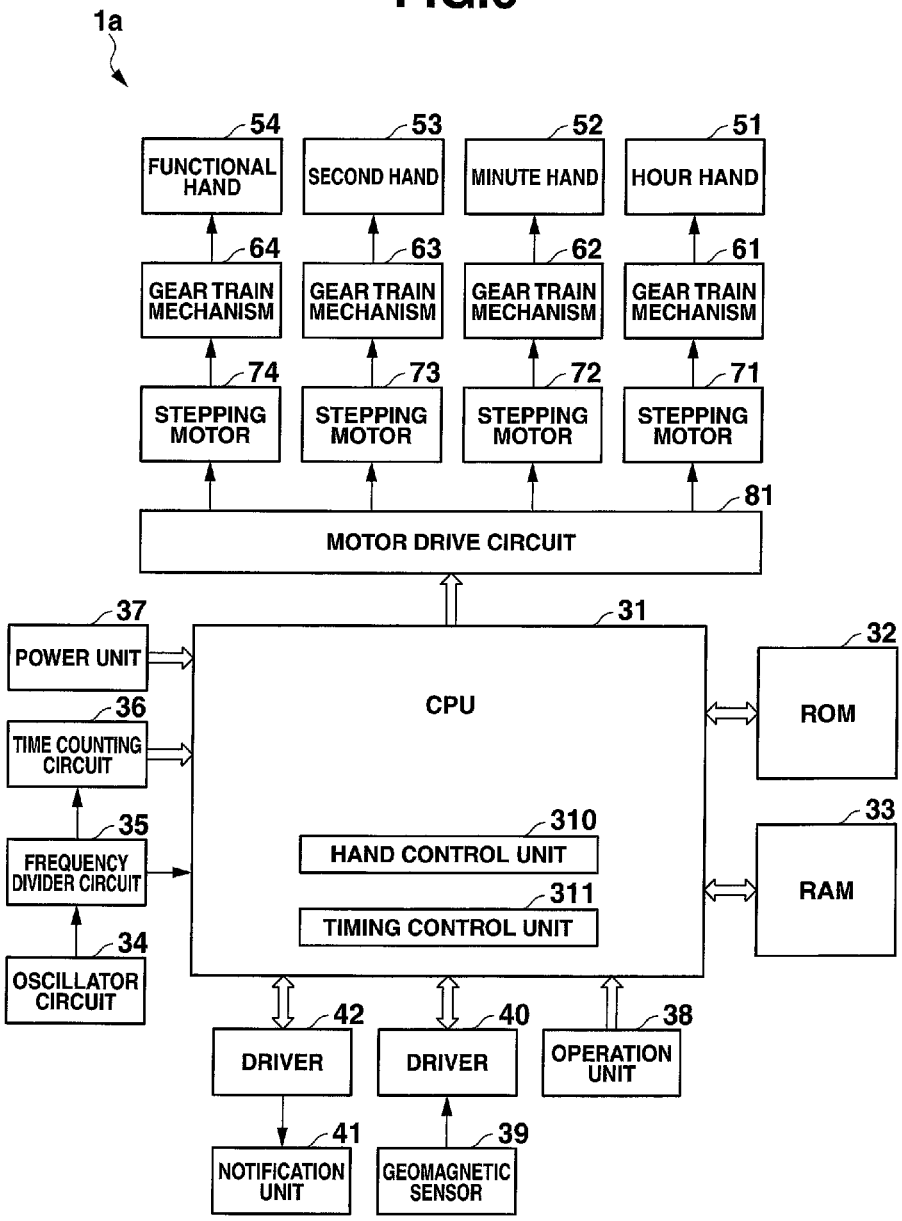
FIG. 6 is a block diagram showing an internal configuration of an analog electronic timepiece of a second embodiment.

FIG. 6 is a block diagram showing an internal configuration of the analog electronic timepiece 1*a* of the second embodiment.

The analog electronic timepiece 1*a* of the second embodiment is similar to the analog electronic timepiece 1 of the first embodiment except that a stepping motor 74 driven by the motor drive circuit 81 is added and a gear train mechanism 64 and a functional hand 54 which are rotated by the stepping motor 74 are added, and thus the description is omitted by providing same reference numerals to the same configuration elements.

The functional hand 54 may be the fourth hand for which the rotation shaft is provided at the same position as the hour hand 51, the minute hand 52 and the second hand 53, and may also be a small hand which rotationally moves around a rotation shaft which is separately provided at another position on the dial plate. The functional hand 54 of the embodiment can rotationally move by six degrees and makes one rotation on the dial plate by the rotation operation of 60 steps. The functional hand 54 can be fast forwarded at 64 pps in the forward direction and 32 pps in the backward direction at fastest similarly to the other hands 51 to 53.

Next, operations according to the direction display of the analog electronic timepiece 1*a* of the second embodiment will be described.

Figure 7A:
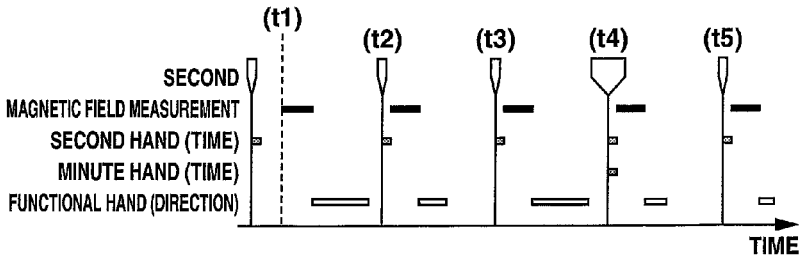
FIGS. 7A to 7C are time charts which explain timings of magnetic field measurement and hand operation in the analog electronic timepiece of the second embodiment.
Figure 7B:
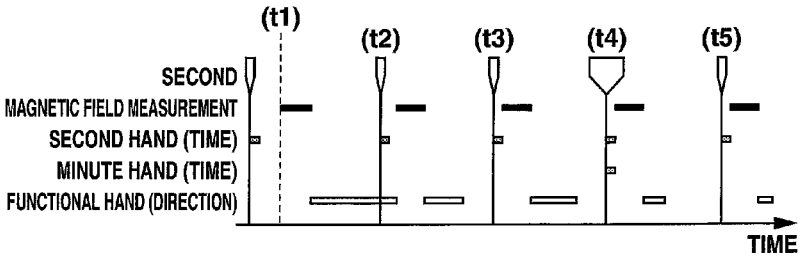
Figure 7C:
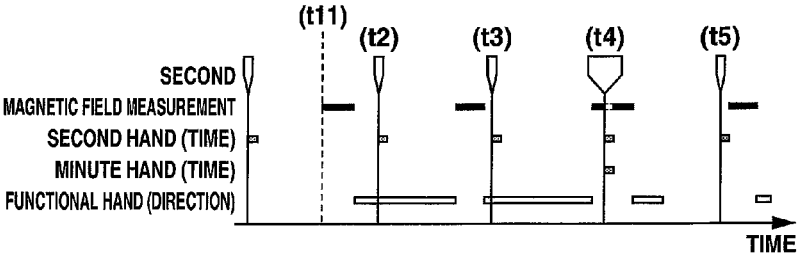

FIGS. 7A to 7C are time charts showing timings of magnetic field measurement and hand operation in a case where time display and direction display are simultaneously performed in the analog electronic timepiece 1*a* of the second embodiment.

In the analog electronic timepiece 1*a* of the embodiment, time display as usual is performed by the hour hand 51, the minute hand 52 and the second hand 53 (hereinafter, collectively called time hands 51 to 53 in the second embodiment) while displaying direction by the functional hand 54. At that time, since the user perceives unnatural when the hand moving timing of the second hand 53 is shifted from the second synchronization point, as shown in FIG. 7A, the operation of the second hand 53 is performed in priority every second. Also, since the user perceives unnatural when the operation timing of the second hand 53 is shifted from the operation timing of the hour hand 51 and the minute hand 52, at the timings such as ten seconds carry when the minute hand 52 and the hour hand 51 are operated, the hands are moved following the second hand 53. Thereafter, similarly to the analog electronic timepiece 1 of the first embodiment, magnetic field measurement and operation of the functional hand 54 are performed. However, in the analog electronic timepiece 1*a*, no problem occurs even when daring to separate the operation timing of the second hand 53 from the operation timing of minute hand 52 and hour hand 51 since the accuracy in time display is secured by maintaining the operation timing of the second hand 53.

Here, as shown in the timing (t2) of FIG. 7B and timings (t2) and (t3) of FIG. 7C, in a case where the movement operation of the functional hand 54 takes time and the movement is not finished by the next second synchronization point, as shown in the timing (t2), the drive voltage pulse according to the movement of the second hand 53 is inserted in the output of the drive voltage pulse according to the movement of the functional hand 54, and the second hand 53 is moved. Accordingly, the movement timing of the second hand 53 is accurately secured. Furthermore, the functional hand 54 needs not stop moving and can appear to a user to be continuously moving.

On the other hand, as shown in the timing (t4) of FIG. 7C, in a case where the second synchronization point is included in the period of magnetic field measurement, in the analog electronic timepiece 1*a*, the bad influence by the hand movement to the magnetic field measurement is prevented while accurately maintaining the hand moving timing of the second hand 53 by interrupting the magnetic field measurement and moving the second hand 53 during the interruption.

Next, a control procedure by the CPU 31 of the hand movement processing which is executed in the analog electronic timepiece 1*a* of the embodiment will be described.

The control procedure of the hand movement processing of the embodiment is similar to the hand movement processing executed by the analog electronic timepiece 1 of the first embodiment shown in FIG. 3, and thus the explanation thereof is omitted.

Figure 8:
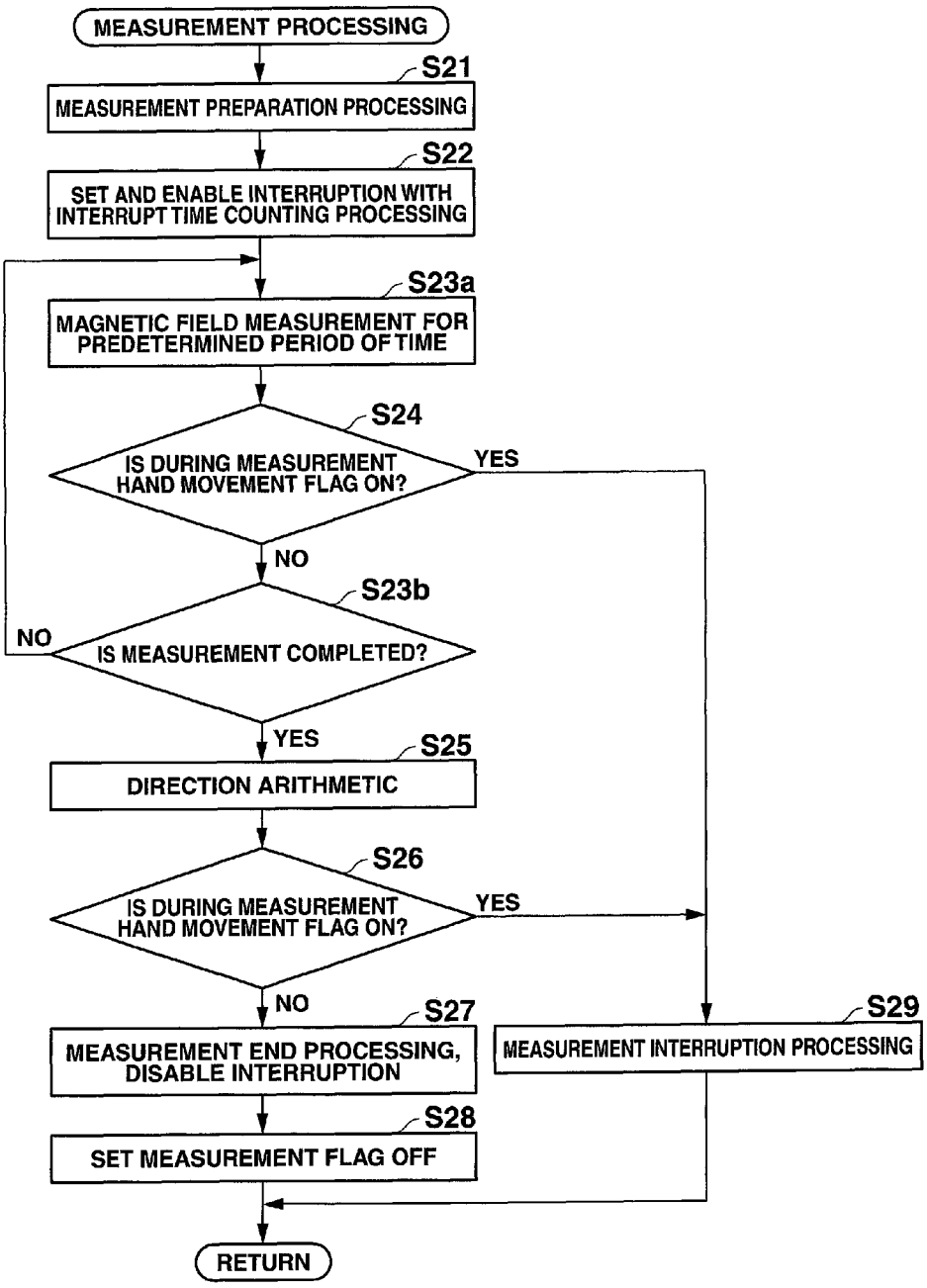
FIG. 8 is a flowchart showing a control procedure of measurement processing of the second embodiment.

FIG. 8 is a flowchart showing a control procedure by the CPU 31 of measurement processing invoked in the hand movement processing of the second embodiment.

In the measurement processing executed in the analog electronic timepiece 1*a* of the second embodiment, compared to the measurement processing executed in the analog electronic timepiece 1 of the first embodiment, the processing of step S23 is changed to processing of steps S23*a* and S23*b*, and processing of steps S24, S26 and S29 are added to correct the processing flow. The other processing is similar to the measurement processing of the first embodiment, and thus the explanation thereof is omitted by providing same reference numerals.

After setting and enabling execution of the interrupt processing in the measurement processing (step S22), the CPU 31 performs the magnetic field measurement (step S23*a*). The CPU 31 determines whether a "during measurement hand movement flag" to be described in detail later is on at every predetermined measurement time, the during measurement hand movement flag indicating that the current time is a hand moving timing (step S24). If it is determined that the during measurement hand movement flag is on (YES in step S24), the processing of the CPU 31 shifts to step S29.

If it is determined that the during measurement hand movement flag is not on (NO in step S24), the CPU 31 determines whether the magnetic field measurement is completed (step S23*b*). If it is determined that the measurement is not completed (NO in step S23*b*), the processing of the CPU 31 returns to step S23*a* and the magnetic field measurement is continued.

IF it is determined that the magnetic field measurement is completed (YES in step S23*b*), processing of the CPU 31 shifts to step S25, and the CPU 31 performs the direction arithmetic on the basis of the measured data (step S25). Thereafter, the CPU 31 determines again whether the during measurement hand movement flag is on (step S26). If the CPU 31 determines that the during measurement hand movement flag is not on (NO in step S26), the processing of the CPU 31 shifts to step S27. If the CPU 31 determines that the during measurement hand movement flag is on (YES in step S26), processing of the CPU 31 shifts to step S29.

When shifting to the processing of step S29 after following the "YES" arrow of the determination processing in step S24 or step S26, the CPU 31 performs measurement interrupt processing (step S29). The CPU 31 continues storing the measured data while performing various processing settings so as not to influence the direction arithmetic processing using the data around the interruption. Then, the CPU 31 goes through the measurement processing to return to the hand movement processing.

Figure 9A:
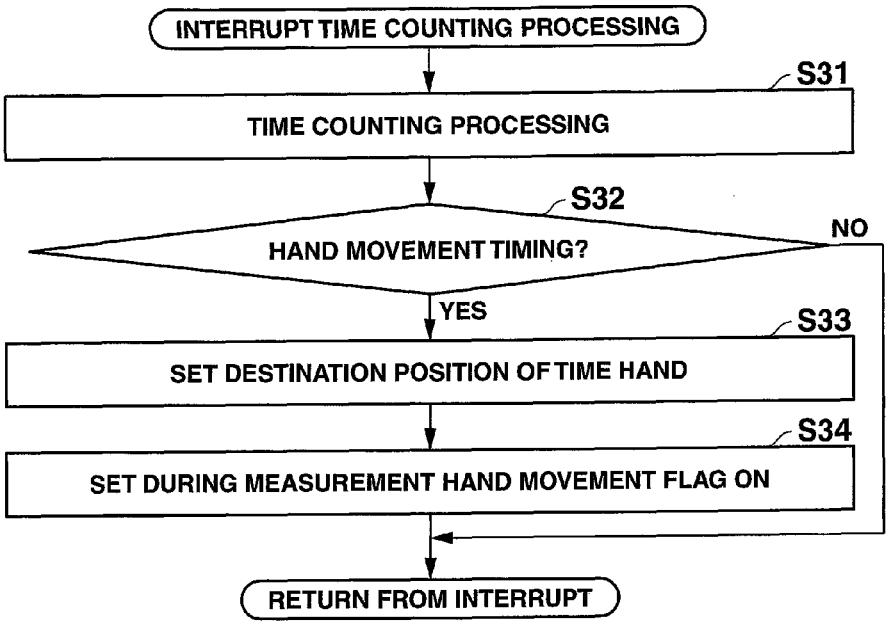
FIGS. 9A and 9B are flowcharts showing control procedures of "interrupt time counting processing" and "after measurement fast forward setting processing" of the second embodiment.
Figure 9B:
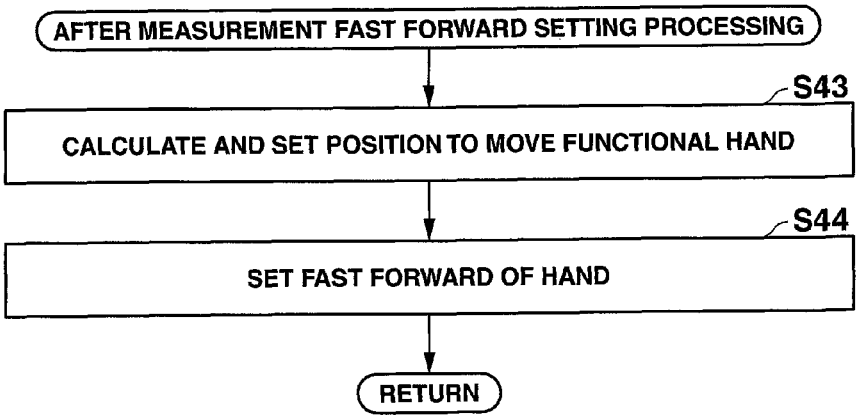

FIGS. 9A and 9B are flowcharts showing control procedures by the CPU 31 of the "interrupt time counting processing" which is executed by interrupting the measurement processing of the second embodiment and the "after measurement fast forward setting processing", respectively.

As shown in FIG. 9A, the interrupt time counting processing of the second embodiment is the interrupt time counting processing of the first embodiment to which the processing of step S34 is added. When it is determined that the current time is the hand moving timing (YES in step S32) and after the destination positions of the time hands 51 to 53 are set (step S33), the CPU 31 sets the during measurement hand movement flag on (step S34). Then, the CPU 31 ends the interrupt time counting processing and returns the processing to the initial processing position in the measurement processing.

As shown in FIG. 9B, the after measurement fast forward setting processing which is performed after the measurement processing is finished is the after measurement fast forward setting processing of the first embodiment in which the processing of steps S41 and S42 is changed to the processing of step S43.

When the after measurement fast forward setting processing is started, the CPU 31 calculates the position to move the functional hand 54 and the direction to rotationally move the functional hand 54 according to the calculated direction of magnetic north and sets the position and direction along with the fast forward speed (step S43). Then, the CPU 31 sets a fast forward flag (step S44) and ends the after measurement fast forward setting processing.

Here, in a case where the measurement interrupt processing is performed in the processing of step S29 and the processing returns from the measurement processing to the hand movement processing, both of the measurement flag and the during measurement hand movement flag are on. In such case, no processing is executed in the processing of step S20, and the hand movement processing ends once. Then, in the hand movement processing which is activated next, the processing follows the "YES" arrow of the determination processing of step S12 on the basis of the during measurement hand movement flag, and follows the "NO" arrow of the determination processing of step S14 to move the time hands 51 to 53 to be driven. Thereafter, the during measurement hand movement flag is reset to be off. The processing follows the "YES" arrow of the determination processing of step S18 on the basis of the measurement flag and returns to the measurement processing.

As described above, in the analog electronic timepiece 1*a* of the second embodiment, time display by the hour hand 51, the minute hand 52 and the second hand 53 and direction display by the functional hand 54 which is independently driven by the stepping motor 74 can be simultaneously and continuously performed during a predetermined period.

When the current time becomes the operation timing of the stepping motors 71 to 73, that is, the hand moving timing of hands 51 to 53 during magnetic field measurement, contrary to the analog electronic timepiece 1 of the first embodiment, the magnetic field measurement is interrupted and the stepping motors 71 to 73 are operated first. Accordingly, as for the operation of hands such as the second hand 53 in which a gap in timing of movement operation is easy to perceive as unnatural for a user, the operation of the hand is performed in priority and the magnetic field measurement is interrupted to effectively utilize the measured portion, and thus, even in a case where time and direction display are performed in parallel with an approximate second accuracy in the analog electronic timepiece 1*a*, the desired display accuracy is not lowered and high time resolution can be maintained. As a result, the generation of display delay and such like which is unpredictable for a user is suppressed, and the user can comfortably obtain the time information and the information according to direction display.

Also, since the magnetic field display can be continuously performed at high accuracy while maintaining the accuracy of time display performed in a normal analog electronic timepiece by the time display including the second hand 53 especially, display according to a plurality of functions can be performed in parallel without lowering either of the accuracy or the time resolution.

The present invention is not limited to the above embodiments, and various changes can be made.

For example, the above embodiments are described by taking a case where a hand used for direction display according to the magnetic field measured every second is rotated by six degrees and fast forwarded at 32 pps. However, the present invention is not limited to this combination. The same effect can be obtained by applying the present invention to a combination in which time of magnetic field measurement and time required for moving hands can be long compared to the measurement interval of magnetic field. Even in a case where the interval of magnetic field measurement is large, the present invention can be applied when the hand operation according to time display can be performed during the magnetic field measurement by the relation between the interval of magnetic field measurement and the interval of hand operation.

Though the above embodiments have been described by taking a case where the analog electronic timepiece includes the hour hand 51, the minute hand 52 and the second hand 53 and a case where the analog electronic timepiece includes the hour hand 51, the minute hand 52, the second hand 53 and the functional hand 54, a different hand may be further provided. Though the above embodiments have been described by taking, as an example, a configuration in which all the hands are independently driven, the configuration may be such that the hour hand 51 and the minute hand 52 are rotated in conjunction with the drive of one stepping motor, for example, as long as the hand to display direction can be independently moved. The present invention can also be applied similarly in a case where an operation interval (predetermined time interval) of the second hand 53 is 0.5 second or two seconds and in a case where the hand movement is possible at 64 pps or 96 pps. In such case, visual cognitive ability, attention and subjective view of a user influences the allowable degree of gap in operation timing compared to the operation interval of time hands, especially the second hand 53. Accordingly, appropriate setting can be made by setting, for example, to be within ten seconds or within two seconds, the range of setting time (predetermined setting time) according to the operation interval of performing the hand operation according to time display in priority to the magnetic field measurement in accordance with the combination of the above parameters and the segment of users of the analog electronic timepiece. Also, the setting time may be changeable by user's operation.

Though only one hand is used for displaying the magnetic field in the embodiments, two or more hands, for example, two hands which are second hand 53 and functional hand 54 rotating around the same shaft may be rotated in directions which are 180-degree opposite to each other to enable clear indication that the magnetic field display which is not time display is performed.

Though the during measurement hand movement flag which is set on in the interrupt time counting processing is detected at predetermined time intervals during the measurement processing in the second embodiment, in a case where the time to obtain a unit of data in measurement processing is changeable, the during measurement hand movement flag may be detected for each processing per unit of data. Alternatively, the interrupt time counting processing may include processing of directly notifying the setting of the during measurement hand movement flag to the measurement processing.

As for the other details such as specific configurations, control contents and procedures shown in the above embodiments, changes can be appropriately made within the scope of the present invention.

The entire disclosure of Japanese Patent Application No. 2013-019997 filed on Feb. 5, 2013 including description, claims, drawings, and abstract are incorporated herein by reference in its entirety.

What is claimed is:

1. An analog electronic timepiece, comprising:

a magnetic field measurement unit which measures the Earth's magnetic field;

a time counting unit;

a plurality of hands which are arranged so as to be rotatable;

a hand control unit which controls rotation of the plurality of hands by activating a stepping motor; and a timing control unit which performs control such that a period of time for executing the rotation of the hands by the hand control unit does not overlap with a period of time for measuring the Earth's magnetic field by the magnetic field measurement unit, wherein:

at least one hand of the plurality of hands is an independent drive hand(s) which is rotatable independently from other hand(s) by the hand control unit, the hand control unit performs control such that at least one of the independent drive hand(s) indicates a predetermined direction based on data measured by the magnetic field measurement unit, and such that other hand(s) among the plurality of hands, which are time hand(s), indicate a current time at a predetermined time interval, the current time being counted by the time counting unit, when the current time becomes a timing for performing a movement operation of the time hand(s) to indicate a change in time while the measurement of the magnetic field is being performed, in a case in which the time hand(s) includes a hand for which the predetermined time interval is less than a predetermined setting time, the timing control unit interrupts the measurement of the magnetic field and performs the movement operation of the time hand(s), and in a case in which the time hand(s) does not include the hand for which the predetermined time interval is less than the predetermined setting time, the movement operation of the time hand(s) is postponed until the measurement of the magnetic field is finished.

2. The analog electronic timepiece according to claim 1, wherein:

the timing control unit sets a measurement command of the magnetic field at a preset time interval of the measurement of the magnetic field, and in a case in which the measurement of the magnetic field according to a previous measurement command is being executed when the measurement command is set, the timing control unit cancels a setting of the measurement command by ending the measurement of the magnetic field.

3. The analog electronic timepiece according to claim 2, wherein, in a case in which the measurement command is set during a movement period of any of the plurality of hands, the hand control unit executes the measurement command after the movement period is over.

4. The analog electronic timepiece according to claim 3, wherein:

the plurality of hands include an hour hand, a minute hand, and a second hand, and in a case in which the hand control unit controls the second hand as the hand that indicates the predetermined direction, and when the current time becomes a timing of a movement operation of the other hands during the measurement of the magnetic field, the timing control unit performs the movement operation of the other hands after the measurement of the magnetic field is finished.

5. The analog electronic timepiece according to claim 4, wherein the hand control unit sets a movement speed in a forward direction and a movement speed in a backward direction so as to be equal to each other when moving the hand that indicates the predetermined direction to a position corresponding to the predetermined direction.

6. The analog electronic timepiece according to claim 3, wherein:

the plurality of hands include an hour hand, a minute hand, a second hand, and a functional hand, and in a case in which the hand control unit controls the functional hand as the hand that indicates the predetermined direction, and when the current time becomes a timing of a movement operation of the other hands during the measurement of the magnetic field, the timing control unit interrupts the measurement of the magnetic field and performs the movement operation of at least the second hand among the other hands.

7. The analog electronic timepiece according to claim 6, wherein the hand control unit sets a movement speed in a forward direction and a movement speed in a backward direction so as to be equal to each other when moving the hand that indicates the predetermined direction to a position corresponding to the predetermined direction.

8. The analog electronic timepiece according to claim 3, wherein the hand control unit sets a movement speed in a forward direction and a movement speed in a backward direction so as to be equal to each other when moving the hand that indicates the predetermined direction to a position corresponding to the predetermined direction.

9. The analog electronic timepiece according to claim 2, wherein:

the plurality of hands include an hour hand, a minute hand, and a second hand, and in a case in which the hand control unit controls the second hand as the hand that indicates the predetermined direction, and when the current time becomes a timing of a movement operation of the other hands during the measurement of the magnetic field, the timing control unit performs the movement operation of the other hands after the measurement of the magnetic field is finished.

10. The analog electronic timepiece according to claim 9, wherein the hand control unit sets a movement speed in a forward direction and a movement speed in a backward direction so as to be equal to each other when moving the hand that indicates the predetermined direction to a position corresponding to the predetermined direction.

11. The analog electronic timepiece according to claim 2, wherein:

the plurality of hands include an hour hand, a minute hand, a second hand, and a functional hand, and in a case in which the hand control unit controls the functional hand as the hand that indicates the predetermined direction, and when the current time becomes a timing of a movement operation of the other hands during the measurement of the magnetic field, the timing control unit interrupts the measurement of the magnetic field and performs the movement operation of at least the second hand among the other hands.

12. The analog electronic timepiece according to claim 11, wherein the hand control unit sets a movement speed in a forward direction and a movement speed in a backward direction so as to be equal to each other when moving the hand that indicates the predetermined direction to a position corresponding to the predetermined direction.

13. The analog electronic timepiece according to claim 2, wherein the hand control unit sets a movement speed in a forward direction and a movement speed in a backward direction so as to be equal to each other when moving the hand that indicates the predetermined direction to a position corresponding to the predetermined direction.

14. The analog electronic timepiece according to claim 1, wherein:

the plurality of hands include an hour hand, a minute hand, and a second hand, and in a case in which the hand control unit controls the second hand as the hand that indicates the predetermined direction, and when the current time becomes a timing of a movement operation of the other hands during the measurement of the magnetic field, the timing control unit performs the movement operation of the other hands after the measurement of the magnetic field is finished.

15. The analog electronic timepiece according to claim 14, wherein the hand control unit sets a movement speed in a forward direction and a movement speed in a backward direction so as to be equal to each other when moving the hand that indicates the predetermined direction to a position corresponding to the predetermined direction.

16. The analog electronic timepiece according to claim 1, wherein:

the plurality of hands include an hour hand, a minute hand, a second hand, and a functional hand, and in a case in which the hand control unit controls the functional hand as the one hand that indicates the predetermined direction, and when the current time becomes a timing of a movement operation of the other hands during the measurement of the magnetic field, the timing control unit interrupts the measurement of the magnetic field and performs the movement operation of at least the second hand among the other hands.

17. The analog electronic timepiece according to claim 16, wherein the hand control unit sets a movement speed in a forward direction and a movement speed in a backward direction so as to be equal to each other when moving the hand that indicates the predetermined direction to a position corresponding to the predetermined direction.

18. The analog electronic timepiece according to claim 1, wherein the hand control unit sets a movement speed in a forward direction and a movement speed in a backward direction so as to be equal to each other when moving the hand that indicates the predetermined direction to a position corresponding to the predetermined direction.

* * * * *